US010202789B2

(12) United States Patent
Sowter

(10) Patent No.: US 10,202,789 B2
(45) Date of Patent: Feb. 12, 2019

(54) DOOR CHECK AND RELEASE MECHANISM

(71) Applicant: Steve Sowter, Sterling Heights, MI (US)

(72) Inventor: Steve Sowter, Sterling Heights, MI (US)

( * ) Notice: Subject to any disclaimer, the term of this patent is extended or adjusted under 35 U.S.C. 154(b) by 61 days.

(21) Appl. No.: 15/368,790

(22) Filed: Dec. 5, 2016

(65) Prior Publication Data

US 2017/0198506 A1 Jul. 13, 2017

Related U.S. Application Data

(60) Provisional application No. 62/262,516, filed on Dec. 3, 2015.

(51) Int. Cl.

| | |
|---|---|
| ***E05F 3/00*** | (2006.01) |
| ***E05C 17/08*** | (2006.01) |
| ***E05C 17/30*** | (2006.01) |
| ***E05F 3/22*** | (2006.01) |

(52) U.S. Cl.
CPC ..... *E05C 17/085* (2013.01); *E05C 17/30* (2013.01); *E05F 3/00* (2013.01); *E05F 3/221* (2013.01); *E05Y 2900/132* (2013.01)

(58) Field of Classification Search
CPC ..... E05C 17/085; E05C 17/22; E05F 3/00; E05F 3/22; E05F 5/06; E05Y 2900/132
(Continued)

(56) References Cited

U.S. PATENT DOCUMENTS 2,229,512 A * 1/1941 Lustig ..... E05C 17/085 217/60 F
2,229,513 A * 1/1941 Lustig ..... E05C 17/085 16/32

(Continued)

*Primary Examiner* — Roberta S Delisle
(74) *Attorney, Agent, or Firm* — John R. Benefiel

(57) ABSTRACT

A check and release mechanism for holding a door in a desired opened position against the force of a closing cylinder which is separate but alongside a door closing actuator which acts to close the door upon its release, the catch and release mechanism includes a catch and release operator rod separate from an actuator operator rod and parallel thereto moved, the door catch and release operating rod has a latch element pivotally mounted to one side of the catch and release operator rod and is moved along a guide slot in a catch and release mechanism case, by continued opening movement of the door into an enlarged engagement chamber in the case, and the leading end of the latch element engages a first fixed feature therein at the approximate location where it is desired to hold the door open. That engagement causes a slight tilting of the latch element and stops further opening advance of the door and operating rod. A slight retraction of the door and the catch and release operating rod causes a trailing end of the tilted latch element to engage a second fixed feature in the chamber which causes the latch element to tilt further in the same direction preventing further closing movement of the door. The engagement of the latch element with the second fixed feature is released by manually moving the door back in the opening direction, causing one side of the tilted latch element to engage the first fixed feature to tilt the latch element further, and upon release the door again moves in the closing direction and the opposite side of the latch element then contacts the second fixed feature be pivoted so as to again be in alignment with the guide slot, allowing the door to close with the latch element advancing down the guide slot.

6 Claims, 4 Drawing Sheets

(58) Field of Classification Search
USPC ..... 16/49, 84, 85
See application file for complete search history.

(56) References Cited

U.S. PATENT DOCUMENTS

| | | | | | |
|---|---|---|---|---|---|
| 2,229,615 | A | * | 1/1941 | Van Voorhees | E05C 17/085 217/60 F |
| 2,242,041 | A | * | 5/1941 | North | E05C 17/085 217/60 F |
| 2,996,210 | A | * | 8/1961 | Thomas | E05C 17/085 217/60 F |
| 3,538,537 | A | | 11/1970 | Strauss | |
| 3,785,004 | A | * | 1/1974 | Stoffregen | E05C 17/085 16/49 |
| 3,985,213 | A | | 10/1976 | Braggins | |
| 4,357,731 | A | | 11/1982 | Strauss | |
| 4,644,617 | A | * | 2/1987 | Tupper | B63H 9/10 24/114.5 |
| 4,815,163 | A | | 3/1989 | Simmons | |
| 5,659,925 | A | | 8/1997 | Patterson | |
| 6,904,643 | B2 | | 6/2005 | Duffy | |
| 2009/0079203 | A1 | * | 3/2009 | Huang | E05C 17/085 292/64 |

* cited by examiner

DOOR CHECK AND RELEASE MECHANISM

CROSS REFERENCE TO RELATED APPLICATIONS

This application claims the benefit of U.S. provisional application No. 62/262,516 filed on Dec. 3, 2015.

BACKGROUND OF THE INVENTION

This application concerns door check and release mechanisms, which selectively hold a door in an opened position and which can be released to allow the door to swing closed by a spring or gas cylinder.

Such mechanisms have been devised in the past, as for example described in U.S. Pat. No. 3,538,537, but these mechanisms are typically complex and not always reliable in operation.

It is an object of the present invention to provide such a door check and release mechanism which is relatively simple, with few moving parts and while being very reliable in operation.

SUMMARY OF THE INVENTION

The above recited object and other objects which will be understood by those skilled in the art are achieved by a check and release mechanism combined with a conventional hydraulic, gas or spring cylinder positioned alongside the mechanism which urges the door to close when the door is released.

The check and release mechanism includes a case with an elongated operator rod slidable therein in a lengthwise extending wide slot formed in the housing.

One end of the rod is connected to the gas spring cylinder mounted to a bracket fixed to a door frame so that the rod is reciprocated as the door opens and closes.

An elongated latching element is pivoted to one side of the rod so as to move therewith, a guide slot slidably receives the latch element guides its motion so that the door may freely be swung open.

As the door approaches a fully open position, the guide slot opens into an enlarged engagement chamber.

After the latch element is moved across the engagement chamber, its leading end engages a first fixed feature at the far end of the chamber which causes the latch element to tilt out of alignment with the operator rod to a predetermined limited degree and blocks any further movement of the operator rod and prevents any further tilting of the latch element.

Upon release of the door, the operator rod is retracted slightly as the door is urged to move to close, carrying the tilted latch element back until its trailing end engages a second fixed feature which engagement acts to further tilt the latch element in the same direction, and thereafter prevent any further tilting of the latch element (and any further closing motion of the operator rod), thereby holding the door open at that opened position.

To release the mechanism, the door is manually moved back towards its full open position, and the tilted latch element again engages the first fixed feature but with a now sideways facing lower side of the latching element, which is thereby pivoted to an opposite inclination away from the second fixed feature.

If the door is released to be moved in a closing direction, the operator rod continues to retract until the now exposed opposite side of the latch element engages the fixed second feature. This causes the latch element to be pivoted back to an inverted position on but again aligned with the guide slot, allowing the door to be closed.

The latching element may be formed with a V shaped recess on each end. The leading end V shaped recess engages the first fixed feature comprising a rounded lobe located slightly below the center of the latch element pivot, causing the latch element to be pivoted to a slightly tilted position as the latching element comes to a stop against the fixed lobe feature when an opened position of the door is reached at which it is desired to be held.

When the door is released, the latch element and operator rod move back towards the second fixed feature, preferably comprised of a corner, which is captured by the V shaped recess on the trailing end of the latch element to prevent further tilting motion of the latch element or movement of the operator rod and door to be held open at that position.

To release, the door is moved back in the opening direction towards the first lobe which now is engaged with the bottom of the top side of the latch element. This swings the latch element away from the fixed corner.

When the door is released to close and the latch element moves with the operating rod, the latch element is further pivoted by engagement of the top side of the formerly bottom side of the latch element with the fixed corner feature, to be moved to be parallel to the guide slot and this allows it to enter the guide slot along which the latch element slides as the door now is allowed to move to the closed position.

DESCRIPTION OF THE DRAWING VIEWS

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
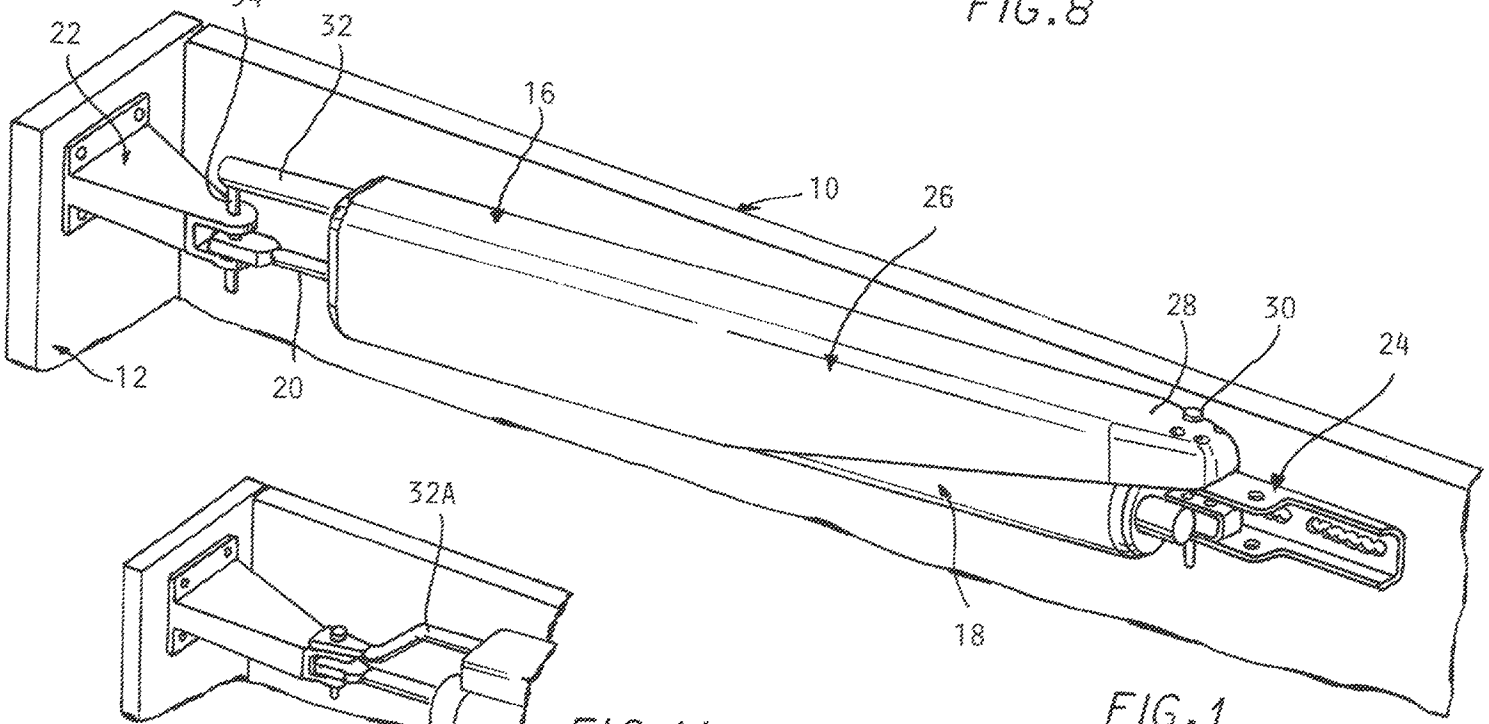
FIG. 1 is a pictorial exterior view of a door check and release mechanism according to the invention combined with a standard spring or gas cylinder door closing mechanism.
Figure 1A:
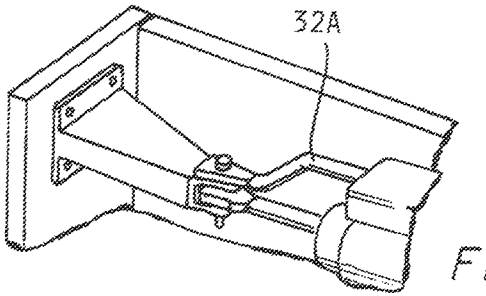
FIG. 1A is a fragmentary pictorial of a variation of an operating rod of the door check and release mechanism shown in FIG. 1.

Referring to FIGS. 1 and 1A, a door 10 is hinged to a building member 12 by a conventional hinges (not shown) so as to be able to be swung open manually and closed under the influence of an actuator, such as a spring or gas cylinder 18. The check and release mechanism 16 has an operator rod 32 pivotally attached to a wall bracket 22 at one end and a casing 26 pivoted to a door bracket 24 at the other end in the conventional manner.

The separate actuator cylinder 18 also has an actuator operating rod 20 (FIG. 1) urging the door 10 to move to the closed position when the door 10 is released, also in the conventional manner.

The check and release mechanism 16 includes a casing 26 and a check and release operator rod 32 separate from the actuator cylinder 18 and actuator operating rod 20 but extending parallel and alongside the actuator cylinder 18 and actuator operator rod 20.

One end 28 of the casing 26 is attached to the door bracket 24 with a pivot pin 30 in one of four holes as shown.

The operator rod 32 protrudes from the other end of the casing 26, which has a connector cross pin 34 extending through aligned holes in the outer end of the wall bracket 22.

A variation of the operator rod 32A (FIG. 1A) may be used having an offset as shown to facilitate mounting to an existing brackets 22.

As the door 10 moves in an opening direction, the casing 26 is moved away from the wall bracket 22, and the operating rod 32, being fixed to the wall bracket 22 (although allowed to pivot about the axis of the connector cross pin 34) is progressively withdrawn from the casing 26 as the door 10 swings open.

Figure 2:
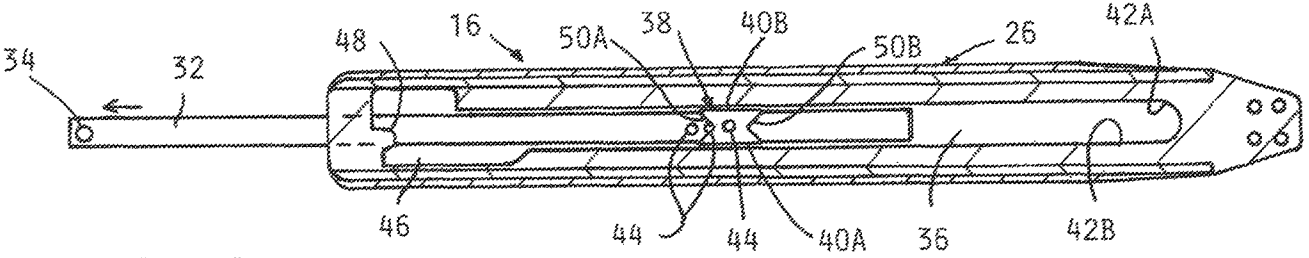
FIG. 2 is a longitudinal sectional view of the door check and release mechanism shown in FIG. 1 in the free travel condition as the door is being manually opened.
Figure 2A:
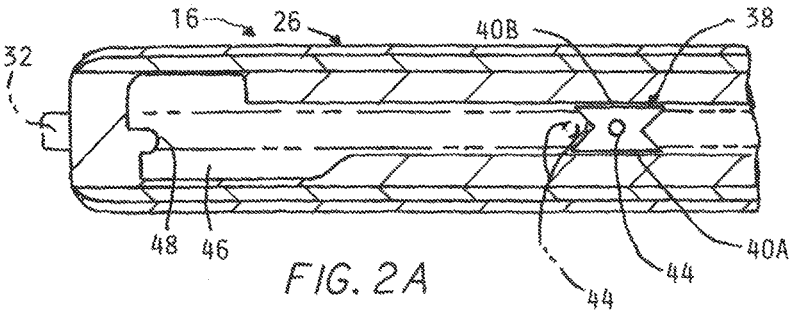
FIG. 2A is an enlarged fragmentary view of the sectional view in FIG. 2.

Referring to FIGS. 2 and 2A, the casing 16 has a long guide slot 36 extending lengthwise within the casing 26 and slidably receives a latch element 38.

The latch element 38 is pivoted to one side of the operator rod 32 as viewed in FIGS. 2-7 at a point nearer the inner end of the operator rod 32. The latch element 38 has parallel top and bottom sides 40A, 40B which are spaced so as to be slidably fit within the guide slot sides 42 while maintaining the sides 40A, 40B of the latch element 38 parallel to the operator rod 32 and guide slot 36 when the door 10 is opened.

When the door 10 reaches a predetermined extent of opening movement, i.e., 90° or some other opening point desired by an appropriate selection of one of a lengthwise extending series of holes 44 to pivotably mount the latch element 38, the latch element 38 passes into an enlarged engagement chamber 46 which is much wider than the guide slot 36 to allow pivoting of the latch element 38 as described below.

Upon continued advance of the check and release operator rod 32, there is an interengagement between the leading end of the latch element 38 and a first fixed feature 48 in the chamber 46 with continued movement of the latch element 38. This engagement causes the latch element 38 to tilt slightly out of alignment with the operator rod 32 to a predetermined slight degree and then positively prevented from tilting any further as well as stopping the operator rod 32 and door from any further advance in an opening direction.

The first fixed feature preferably comprises an off-center fixed rounded lobe 48 located with its center on one side of the operator rod 32, i.e., the lower side as seen in FIGS. 2 and 2A.

The latch element 38 preferably has a V shaped recess 50A at the leading end thereof.

Figure 3:
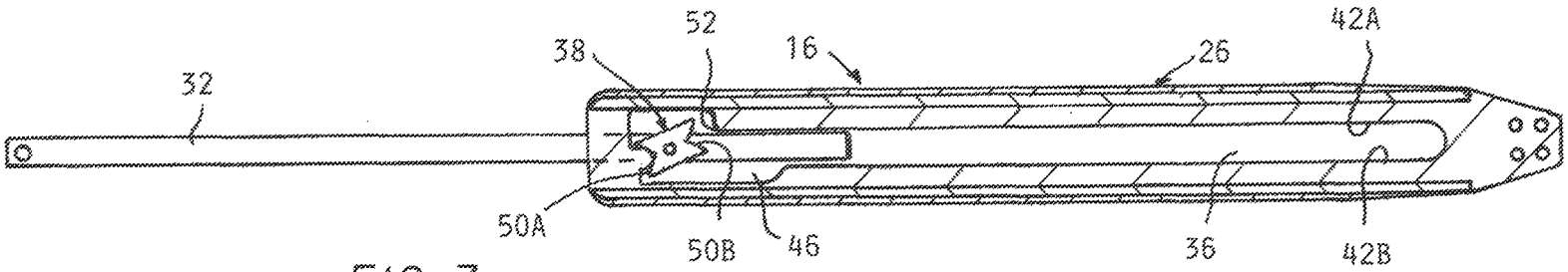
FIG. 3 is a longitudinal sectional view of the door check and release mechanism shown in FIG. 2 with a latching element initially engaged with a rounded lobe first fixed feature to begin the latching action.
Figure 3A:
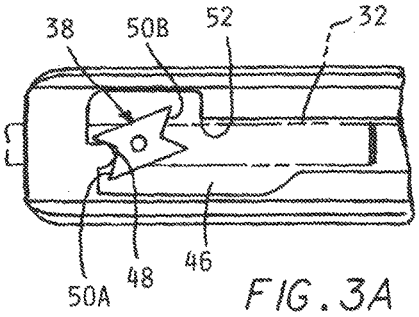
FIG. 3A is an enlarged fragmentary view of the sectional view in FIG. 3.

Upon continued relative movement of the operating rod 32 occurring as the door 10 opens, the lobe 48 is engaged with the lower side of the V shaped recess 50A, forcing the leading end of the latch element 38 to pivot down slightly as seen in FIGS. 3 and 3A. The motion of the operating rod 32 and door is then positively stopped by the engagement of the V shaped recess 50A on the leading end of the latch element 38 with the lobe 48.

When the door 10 is released, it moves back a short distance under the influence of the actuator spring/gas cylinder 18.

A second fixed feature 52 is then engaged by the trailing end of the latch element 38 to further tilt the latch element 38 to a predetermined degree.

Figure 4:
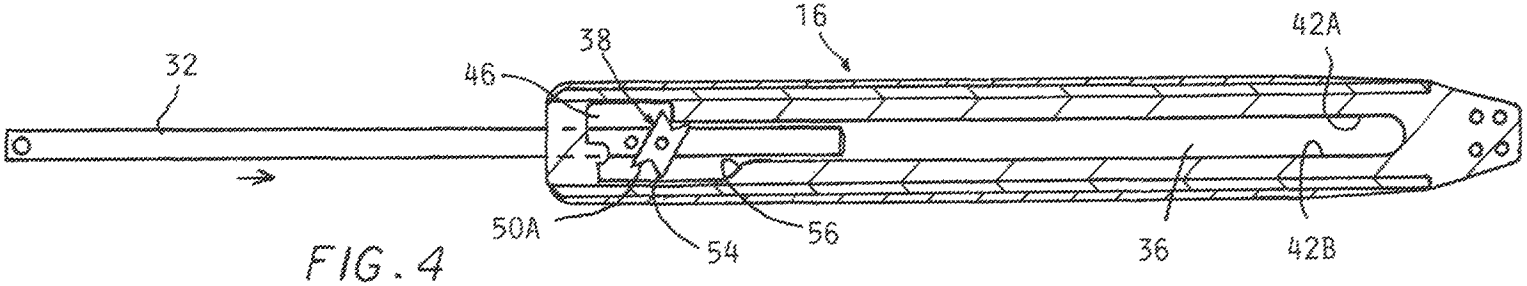
FIG. 4 is a longitudinal sectional view of the door check and release mechanism shown in FIGS. 2 and 3 with the latching element engaged with a fixed corner second feature as the rod is retracted slightly to establish a latched state of the latch element.
Figure 4A:
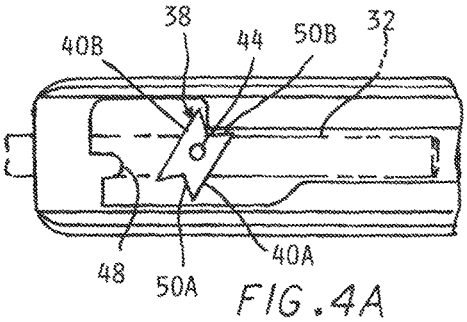
FIG. 4A is an enlarged fragmentary view of the sectional view in FIG. 4.

A V shaped recess 50B on the trailing end of the latch element 38 may advantageously be provided to accomplish this which approaches a corner 52 in the chamber 26 comprising the second fixed feature. The latch element 38 then is partially pivoted further by engagement with the corner 52, as the upper side of the V shaped recess 50B engages with the corner 52 forcing the return side of the latch element 38 to pivot further up as seen in FIGS. 4 and 4A to a predetermined extent.

There is an engagement between the lower edge 54 and the lower surface 56 of the chamber 46 which engagement positively prevents any further tilting of the latch element 38 or closing movement of the check and release operator rod 32 and door 10.

Thus, the door 10 is held open in that position.

Figure 5A:
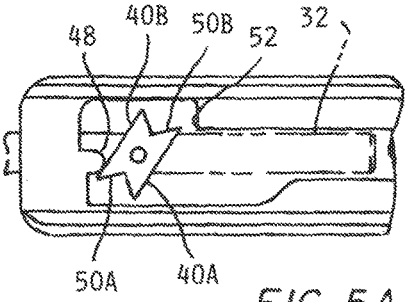
FIG. 5A is an enlarged fragmentary view of the sectional view in FIG. 5.
Figure 5:
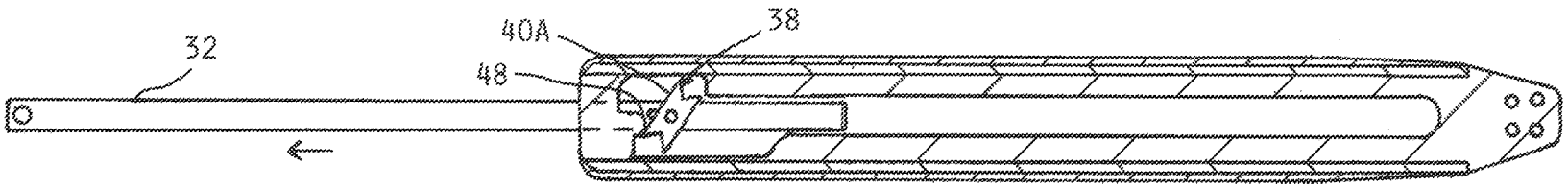
FIG. 5 is a longitudinal sectional view of the door check and release mechanism shown in FIGS. 2 through 4 with the operator rod fully extended once again and the latching element reengaging the rounded lobe first fixed feature but in a manner that begins the release mode of operation of the mechanism.

To release the latch element 38 and the door 10, the door 10 is manually moved back toward the fully opened position. The corresponding movement of the rod 32 again moves the latch element 38 towards the fixed lobe 48 which in the maximally pivoted down position of the latch element 38 now engages the lower end of the top side 40A of the latch element 38, as seen in FIGS. 5 and 5A.

Figure 6A:
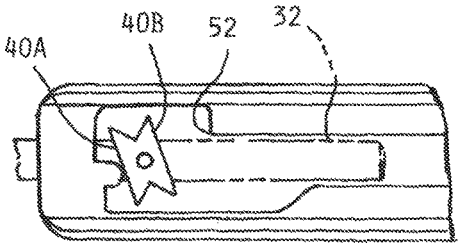
FIG. 6A is an enlarged fragmentary view of the sectional view in FIG. 6.
Figure 6:
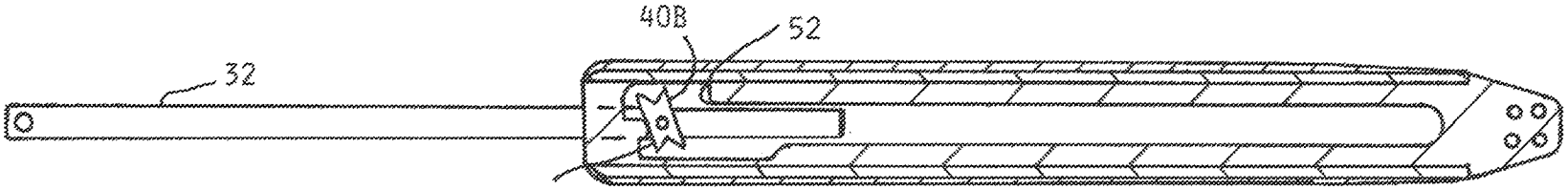
FIG. 6 is a longitudinal sectional view of the door check and release mechanism shown in FIGS. 2 through 5 with the latching element reengaged with the fixed lobe feature as the door and operating rod is manually moved in the opening direction to initiate the releasing action.

Continued opening movement of the door 10 and consequent relative movement of the operating rod 32 causes the top end of the tilted latch element 38 to be swung away from the fixed corner feature 52, aligning what was formerly the lower side 40B thereof with the corner feature 52 as seen in FIGS. 6 and 6A.

Figure 7A:
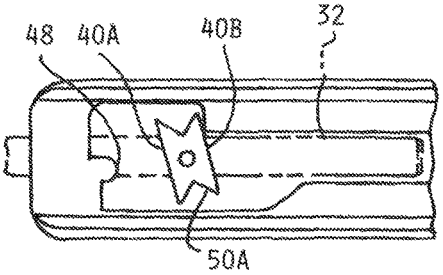
FIG. 7A is an enlarged fragmentary view of the sectional view in FIG. 7.
Figure 7:
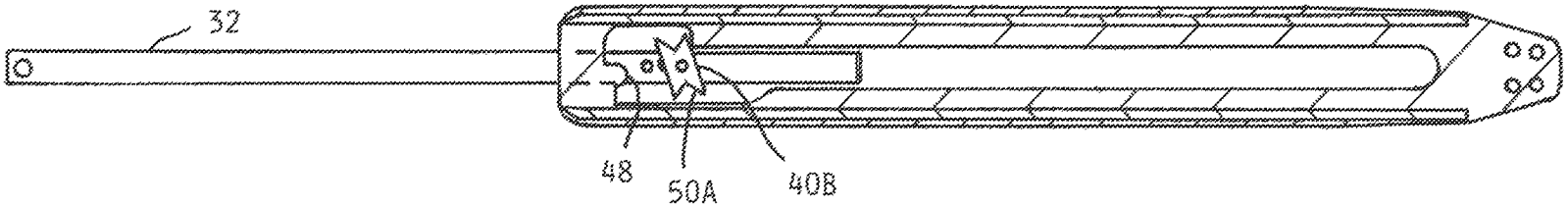
FIG. 7 is a longitudinal sectional view of the door check and release mechanism shown in FIGS. 2-6 with the latch element bottom side engaging the fixed corner feature to begin to realign the latch element with the guide slot sides.

The door 10 is then released and is moved to be closed by the force applied by the cylinder 18. The relative movement of rod 32 carries the latching element 38 back towards the corner feature 52 until the top of the bottom side 40B of the latch element engages the corner feature 52 as seen in FIGS. 7 and 7A.

Figure 8:
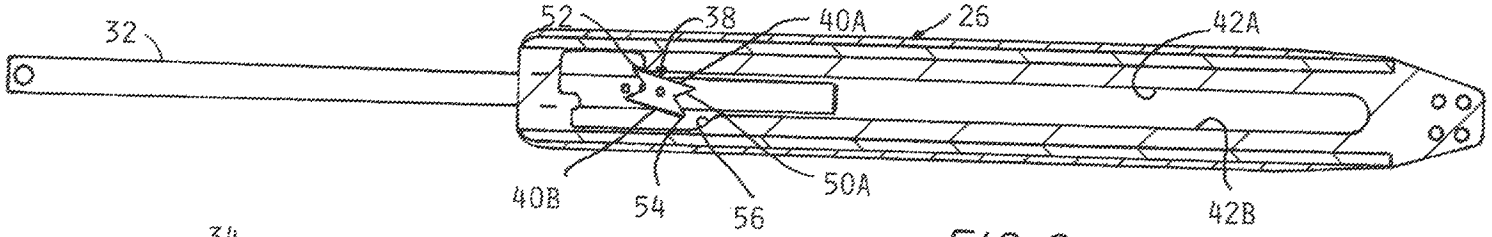
FIG. 8 is a longitudinal sectional view of the door check and release mechanism shown in FIGS. 2 through 7 in the final stage of engagement with the fixed corner feature to complete the releasing action allowing the door to fully close.
Figure 8A:
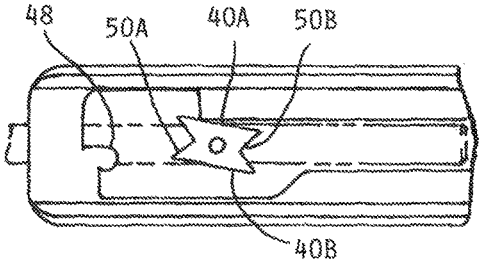
FIG. 8A is an enlarged fragmentary view of the sectional view in FIG. 8.

As seen in FIGS. 8 and 8A, continued closing movement of the operator rod 32 rotates the latch element 38 to align sides 40A, 40B with guide slot sides 42A, 42B as in FIG. 2 although the sides 40A, 40B now being inverted. The sloping surface 56 provides clearance for the bottom edge 54 of the latch element 38 to allow this movement.

It is noted that during this process, the latching element 38 is rotated 180° to be inverted when in a ready condition for another cycle, thus evening out any wear of the respective sides 40A, 40B and V shaped recesses 50A, 50B.

The invention claimed is:

1. A check and release mechanism for a hinged door which is equipped with an actuator which generates a closing force which constantly urges said door to close after being manually opened, said actuator including an elongated operating rod movable in an actuator cylinder, said actuator elongated operating rod having one end extending out of an end of said actuator cylinder, said actuator operating rod connected at an end protruding from said actuator cylinder to said door or to a fixed door frame and an outer protruding end of said check and release operator rod to the same one of said door or said fixed door frame to which said actuator operating rod is connected, said check and release mechanism is selectively operable to hold said door against the force exerted by said actuator at a selected opened position, said check and release mechanism manually releasable to allow said door to be swung closed by said actuator force, said check and release mechanism comprising:

said elongated catch and release operating rod separate from said actuator operator rod and having a casing extending parallel to and alongside said actuator cylinder but spaced therefrom; said catch and release mechanism casing separate from said actuator cylinder, said catch and release rod having one end advanced out of said catch and release casing as said door is swung open from a closed position of said catch and release operator rod;

a latch element pivoted to one side of said catch and release operating rod, said latch element having opposite parallel sides slidable within a guide slot in said catch and release casing, to prevent substantial pivoting of said latching element while in said guide slot;

said guide slot opening into a larger engagement chamber in said catch and release mechanism casing, said latch element carried into said engagement chamber on said catch and release operating rod by continued opening movement of said door;

a first fixed feature within said engagement chamber located on one side of a pivot axis of said latch element on said catch and release operating rod so that said first fixed feature is engaged by a leading end of said latch element, said engagement causing a limited tilting of said latch element as said check and release operating rod and latch element are brought to a stop by said engagement with said first fixed feature;

said door and catch and release operating rod moved back in a closing direction from said engagement of said latch element engages with said first fixed feature thereon with said latch element in said tilted orientation upon release of said door;

a second fixed feature located in said engagement chamber on an opposite side of said catch and release operating rod axis aligned with a trailing end of said tilted latch element so that said latch element will engage said second fixed feature when continued to be moved in a door closing direction, which engagement prevents said door and catch and release operating rod from moving further in a closing direction by said limited closing movement of said door and catch and release operating rod, said latch element tilting further out of alignment with said catch and release operator rod by said tilting caused by said engagement of said trailing end of said latch element with said second fixed feature, to thereby prevent further closing movement of said catch and release operating rod and said door in said closing direction by said actuator closing force.

2. The check and release mechanism according to claim 1 wherein upon manually moving said door in an opening direction to carry said latch element trailing end away from said second fixed feature while remaining tilted, said one of said parallel sides of said latch element is engaged by said first fixed feature to cause said latch element to swing further in the same direction, causing said latch element to be inclined away from said second fixed feature, so that when said door is again released an opposite parallel side of said latch element engages said second fixed feature and swings said latch element so as to be substantially realigned with said guide slot and thereby allow said catch and release operating rod and latch element to slide back towards a door closed position with said formerly leading end of said latch element passing first into said guide slot.

3. The check and release mechanism according to claim 2 wherein said latch element becomes inverted upon completing both of said successive engagements with said first and second fixed features respectively.

4. The check and release mechanism according to claim 1 wherein said leading and rear ends of said latch elements are each formed with a V shaped recess, each engaged with a respective one of said first or second fixed features to capture said latch element by engagement of said respective first and second fixed features with said V shaped recess preventing any further pivoting of said latch element once fully engaged therewith.

5. The check and release mechanism according to claim 4 wherein said first fixed feature comprises a rounded lobe engaging said V shaped recess at the leading end of said latch element forcing said latch element to undergo said slight tilting as said V shaped end engages said rounded lobe and thereafter prevent any further tilting thereof or opening movement of said door and catch and release operating rod.

6. The check and release mechanism according to claim 4 wherein said second fixed feature comprises a corner and said corner enters said V shaped recess at said trailing end of said latch element to be captured therein and wherein said latch element trailing end engages said second fixed feature comprising said corner to thereby immobilize said latch element against further tilting movement.

* * * * *